US006973284B2

(12) United States Patent
Murata

(10) Patent No.: US 6,973,284 B2
(45) Date of Patent: Dec. 6, 2005

(54) INDUCTION HEATING APPARATUS HAVING SHEET RELEASING MECHANISM

(75) Inventor: Hiroshi Murata, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/942,816

(22) Filed: Sep. 17, 2004

(65) Prior Publication Data

US 2005/0031385 A1 Feb. 10, 2005

Related U.S. Application Data

(63) Continuation of application No. 10/391,622, filed on Mar. 20, 2003, now Pat. No. 6,871,039.

(51) Int. Cl.[7] ..... G03G 15/20
(52) U.S. Cl. ..... 399/323; 399/329; 399/300; 219/216; 219/619
(58) Field of Search ..... 399/320, 323, 399/330, 335; 219/216, 469, 388, 619, 643

(56) References Cited

U.S. PATENT DOCUMENTS

| | | | |
|---|---|---|---|
| 5,752,150 | A | 5/1998 | Kato et al. |
| 5,768,673 | A | 6/1998 | Morigami |
| 5,839,043 | A | 11/1998 | Okabayashi et al. |
| 6,078,781 | A | 6/2000 | Takagi et al. |
| 6,400,924 | B1 | 6/2002 | Watanabe |
| 6,560,421 | B1 | 5/2003 | Matsumoto |
| 6,564,031 | B2 | 5/2003 | Murata |
| 6,678,497 | B1 | 1/2004 | Murata |

FOREIGN PATENT DOCUMENTS

| | | | |
|---|---|---|---|
| JP | 8-76620 | A | 3/1996 |
| JP | 9-152804 | A | 6/1997 |
| JP | 10-63126 | A | 3/1998 |
| JP | 2000-214713 | A | 8/2000 |

*Primary Examiner*—Robert Beatty
(74) *Attorney, Agent, or Firm*—Foley & Lardner LLP

(57) ABSTRACT

A fixing apparatus according to the present invention includes a flat coil which is arranged along an inside periphery of a heating roller and is supplied with power for heating the heating roller by means of eddy current. At least two flat coils are provided along the inside periphery of the heating roller and have a magnetic field distribution. A release claw is provided at a position where the magnetic field distribution becomes minimum.

6 Claims, 5 Drawing Sheets

INDUCTION HEATING APPARATUS HAVING SHEET RELEASING MECHANISM

The present application is a continuation of U.S. application Ser. No. 10/391,622, filed Mar. 20, 2003 now U.S. Pat. No. 6,871,039, the entire contents of which are incorporated herein by reference.

BACKGROUND OF THE INVENTION

The present invention relates to a fixing apparatus and an image forming apparatus using the fixing apparatus to fix a toner image (picture) onto a fixing material in image forming apparatuses such as an electrostatic, a laser printer, and the like.

A fixing apparatus installed in the copying machine using electrophotographic processes heats and melts a developer, i.e., toner, formed on a fixing material and fixes the toner on the fixing material.

Many of this type of fixing apparatuses form a working section (nip) at a position where a heating roller or an endless belt contacts with a press roller supplying the heating roller (belt) with a specified pressure. There is widely used a method and a configuration for supplying pressure and heat to the fixing material and toner guided by the nip. Recently, as a toner heating method available for the fixing apparatus, the method using the induction heating is becoming widely used for the sake of a short wait time and low power consumption.

For example, Jpn. Pat. Appln. KOKAI Publication No. 10-63126 discloses the fixing apparatus to heat the roller using the induction heating.

As another example, Jpn. Pat. Appln. KOKAI Publication No. 8-76620 discloses the fixing apparatus that uses a magnetic field generating means to heat a heat-resistant conductive film and fixes toner on paper adhered to the conductive film. The same publication discloses an example of providing a nip by putting the conductive film between the magnetic field generating means and the heating roller.

The fixing apparatus using the heating roller widely uses a technique of thinning a metal roller in order to shorten the time needed for warm-up. In addition, a technique of thinning rubber layers is used for the roller whose surface is provided with a rubber layer so as to be appropriately used for a color image forming apparatus, for example.

Since thinning the rubber layer of the heating roller increases the heating roller hardness, it is proposed to increase the nip width for the purpose of improving a fixing property. For this reason, there is a tendency to soften the surface rubber layer of the press roller that contacts with the heating roller.

Decreasing the press roller hardness curls a fixing medium toward the heating roller. Accordingly, there is reported an example of allowing a releasing mechanism using a claw to contact with the heating roller surface in order to completely separating a fixing medium from the heating roller.

When the releasing mechanism uses the claw, a scratch due to the claw occurs on a toner image, i.e., an image on the fixing medium. Further, there is a problem of causing a release failure, a jam (entanglement), and the like due to toner adhered to the claw. The releasing mechanism using the claw offers a new problem of removing the toner adhered to the claw at a specified interval (for the specified number of image forming operations).

In order to decrease running costs for the fixing apparatus, there may be a case of omitting a cleaner to remove toner remaining on the heating roller surface or applying no release agent (oil) to the heating roller surface. It is impossible to reliably separate a fixing medium used for a color image that especially causes a large toner coating mass.

In addition to the above-mentioned problems, the following occur when using the induction heating method that heats the roller itself by means of an eddy current generated on the metal due to the electromagnetic induction. The induction heating causes magnetic field distribution dependent on coil shapes. Due to an effect of the magnetic field distribution, the surface temperature of the heating roller partially differs. Further, the fixing apparatus using the induction heating easily causes areas generating partially different temperatures along a longer direction of the heating roller depending on the coil arrangement.

BRIEF SUMMARY OF THE INVENTION

It is therefore an object of the present invention to improve the quality of image output fixed to a fixing medium in a fixing apparatus using the induction heating.

The present invention provides an induction heating fixing apparatus comprising: an endless belt-shaped heating target member capable of moving any position; an induction current generation mechanism including first and second coils for allowing the member to be heated to generate an eddy current, wherein the first and second coils are separated into two or more elements at a cross section orthogonal to a direction along which the member to be heated moves; a pressing member which contacts with the member to be heated and can provide a nip having a specified width in cooperation with the member to be heated; and a releasing mechanism which, from the member to be heated, separates a fixing member passing through the nip between the member to be heated and the pressing member, wherein the releasing mechanism is provided at a specified position on an outside periphery of the member to be heated in correspondence with a position causing a maximum gap between wire turns of the first and second coils in the induction current generation mechanism.

Further, the present invention provides a fixing apparatus using induction heating comprising: an endless belt-shaped heating target member capable of moving any position; an induction current generation mechanism including first and second coils for allowing the member to be heated to generate an eddy current, wherein the first and second coils are separated into two or more elements at a cross section orthogonal to a direction along which the member to be heated moves and along a longer direction of the member to be heated; a pressing member which contacts with the member to be heated and can provide a nip having a specified width in cooperation with the member to be heated; and a releasing mechanism which, from the member to be heated, separates a fixing member passing through the nip between the member to be heated and the pressing member, wherein at least one of the releasing mechanisms is provided at a specified position on an outside periphery of the member to be heated in correspondence with a position causing a maximum gap between wire turns of the first and second coils in the induction current generation mechanism, and at a specified position on an outside periphery of the member to be heated in correspondence with a position for separating the first and second coils in the induction current generation mechanism along a longer direction of the member to be heated.

Moreover, the present invention provides an image forming apparatus comprising: a photo conductor capable of retaining an image by being selectively irradiated with light in an electrostatically charged state; a developing apparatus which supplies a visualization material to the image formed on the photo conductor; a first roller which is extended along a first direction and is rotatable around a center shaft along a second direction orthogonal to the first direction; a second roller provided along the first roller in a manner capable of contacting with the first roller, wherein the second roller can supply a specified pressure to the first roller and is elastically deformed to provide a nip having a specified width in conjunction with the first roller; a heating apparatus which is arranged along an inside periphery of the first roller and is supplied with power for heating the first roller by means of eddy current, wherein the heating apparatus comprises at least two flat coils provided along an inside periphery of the first roller and is divided into two or more elements along the first direction of the first roller, a magnetic field generated from the flat coil has a specified distribution in accordance with a position at the inside periphery of the first roller, and a position corresponding to the minimum distribution is shifted from the nip for a specified amount downstream along a direction of rotating an outside periphery of the first roller; a releasing mechanism which separates a fixing member passing through the nip between the first roller and the second roller, from the first roller, wherein the releasing mechanism is provided on an outside periphery of the first roller at a specified position corresponding to a position which minimizes a magnetic field generated by the flat coil of the heating apparatus; and a fixing apparatus which includes a current supply mechanism, heats and melts the visualization material image developed by the developing apparatus, and then presses the image together with the fixing medium to fix the image onto the fixing medium, wherein the current supply mechanism can independently supply electric current to a coil which is selected from the flat coils of the heating apparatus and is divided along the first direction as a specified unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

With reference to the accompanying drawings, the following describes an example of an image reading apparatus capable of applying an embodiment of the present invention and an image forming apparatus containing the image reading apparatus. The description to follow uses a digital copying machine as an example of the embodiment.

Figure 1:
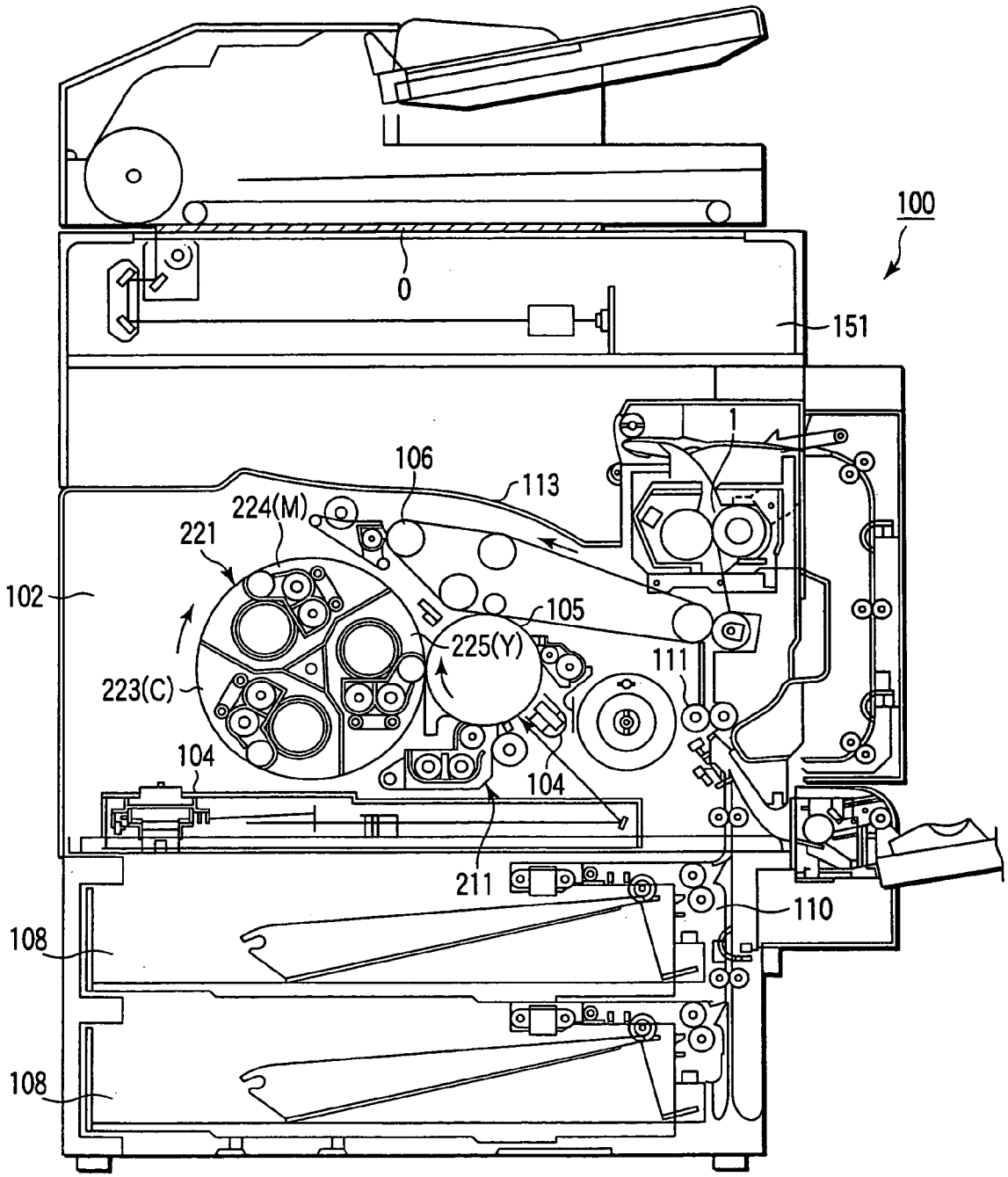
FIG. 1 is a schematic diagram showing a digital copying machine where a fixing apparatus according to an embodiment of the present invention is installed.

As shown in FIG. 1, a color digital copying machine 100 includes a scanner (color image reading apparatus) 151 and an image forming apparatus (MFP=MultiFunctional Pedestal) 102. The scanner 151 reads image information contained in a copy object 0 as contrasts of the light and generates an image signal. The image forming apparatus 102 forms an image corresponding to the image signal supplied from the scanner 151 or from the outside.

The image forming apparatus 102 has, e.g., a photoconductor drum 103 to hold a latent image, an exposure apparatus 104 to irradiate light with varied intensities corresponding to the image information to the photoconductor drum 103, developing apparatuses 211 and 221 to develop a latent image formed on the photoconductor drum, and a fixing apparatus 1.

Image data is read by the scanner 151 and is stored in an image memory (not shown). Based on the image data, intensities of exposure light are modulated. The exposure light is irradiated from the exposure apparatus 104 to a specified position on the photoconductor drum 103. The forms a latent image corresponding to the exposure light intensity on the photoconductor drum 103.

The latent image formed on the photoconductor drum 103 is visualized (developed) as a toner image by selectively supplying toner from the black (Bk) developing apparatus 211 or the color developing apparatus 221 in accordance with the corresponding colors. The developing apparatus 211 develops monochrome black images. The developing apparatus 221 develops monochrome C (Cyan), M (Magenta), and Y (Yellow) color images.

When the photoconductor drum 103 rotates, the toner image on the photoconductor drum 103 is carried to an intermediate transfer position where a transfer belt (intermediate transferrer) 105 and the photoconductor drum 103 oppose to each other.

When carried to the intermediate transfer position, the toner image on the photoconductor drum 103 is transferred to the transfer belt 105 through an intermediate transfer voltage supplied from an intermediate transferring apparatus 106.

The toner image transferred to the transfer belt 105 is carried to a position for transferring toner images to output media, i.e., an area where the transferring apparatus (no reference numeral indicated) and the transfer belt 105 oppose to each other. When the transferring apparatus generates a specified transfer voltage, the toner image is transferred to paper P. The paper P is taken out of a cassette 108 at specified timing and is carried through a carriage path 110. An aligning roller 111 adjusts the timing to the position of the toner image on the photoconductor drum 103 to carry the paper P to the transfer position. When, the paper P may be replaced by colored paper or a transparent resin sheet, request from user.

When the toner image is transferred, the paper P is carried to the fixing apparatus 1 which then supplies specified heat. The heat melts toner constituting the toner image which is then fixed to the paper P.

When the fixing apparatus 1 fixes the toner (not shown) on the paper P, the toner means a duplicate image of the original image or an image output corresponding to the image information supplied from an external apparatus. After such toner is fixed on the paper P, a paper eject roller 112 ejects the paper P to a space defined between the scanner 151 and the sheet cassette 108, i.e., an image output medium holding section (tray) 113.

Figure 2:
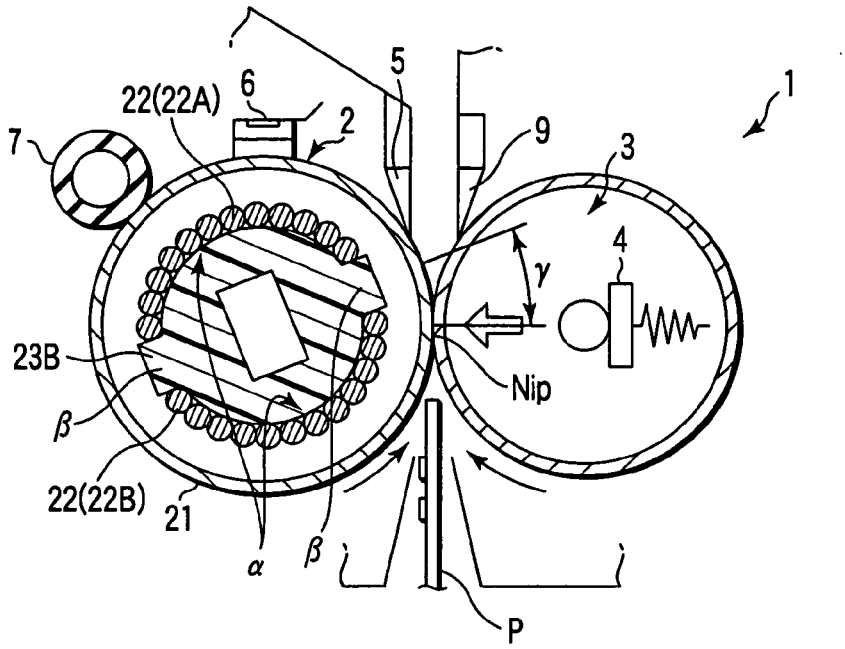
FIG. 2 is a sectional view showing an example of the fixing apparatus installed in the copying machine shown in FIG. 1.

As shown in FIG. 2, the fixing apparatus 1 includes a heating roller 2 and a press roller 3 that are pressed against each other to maintain a specified nip. The heating roller 2 rotates in the direction indicated by the arrow when a driving force generated by a drive motor (not shown) is transmitted to the heating roller 2 via a transmission mechanism (not shown) having gears and the like. A press mechanism 4 presses the press roller 3 against the heating roller 2 with a specified pressure to temporarily deform the press roller 3 less harder than the heating roller 3. The above-mentioned nip is provided between the press roller 3 and the heating roller 2. When the heating roller 2 rotates, an outside peripheral surface of the press roller 3 moves at the same movement speed as that for movement of an outside peripheral surface of the heating roller 2.

There are positioned a plurality of release claws 5, a thermistor 6, and a cleaning member 7 in this order around the heating roller 2 toward downstream of the rotation direction from the nip where the heating roller 2 and the press roller 3 contact with each other. The release claws 5 separate the paper fixed with the toner image from the heating roller 2. The thermistor 6 is a temperature detection mechanism that detects a surface temperature of the heating roller 2. The cleaning member 7 removes unnecessary (unfixed) toner or paper dust adhered to the surface of the heating roller 2.

The heating roller 2 includes a metal roller body 21 and a coil 22. The metal roller body 21 is cylindrically formed in thickness of 1 mm, for example. The coil 22 is provided inside the metal roller body 21 and allows the metal roller body 21 to generate an induction current.

Figure 9:
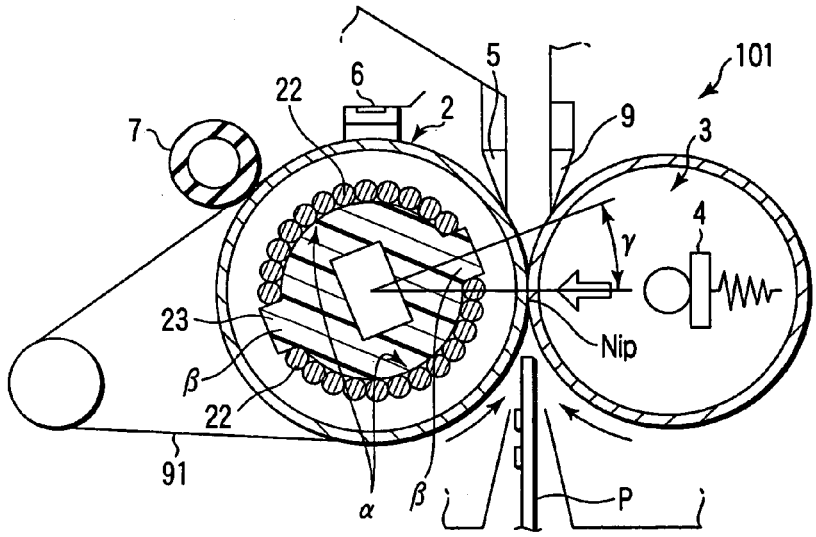
FIG. 9 is a sectional view showing an example of the fixing apparatus differing from that shown in FIG. 2.

Instead of the heating roller 2, it may be preferable to provide a metal film 91 outside the heating roller 2 like a fixing apparatus 101 as shown in FIG. 9. The metal film 91 is a sheet-shaped endless belt formed by accumulating metal for a specified thickness on the surface of a highly heat-resistant resin film.

The roller body 21 of the heating roller 2 can be made of, e.g., pure iron, stainless steel, aluminum, alloy of stainless steel and aluminum, and the like. On the surface of the roller body 21, there is formed a mold-releasing layer having a fluorocarbon resin represented by polytetrafluoroethylene and the like in order to prevent the toner from adhering to the roller surface.

The coil 22 includes first and second coils 22A and 22B having two portions formed by dividing the roller 2 approximately at its center with respect to a sectional direction of the heating roller 2. Each coil 22 is an air-core coil that does not use, e.g., a ferrite or iron core for concentrating a magnetic flux generated from the coil 22 on the roller body 21. A support member 23 is used to position the coil 22 (22A and 22B) as specified so that the coil 22 does not touch the inside periphery of the roller 2.

The support member 23 is made of highly heat-resistant engineering plastics such as a PEEK (poly ether ketone) material, a phenol material, or unsaturated polyester, for example.

Since the coil 22 is configured to be an air-core coil, it is possible to save costs for core materials to be complicatedly shaped. The use of the air-core coil also makes it possible to decrease costs for an excitation circuit.

Each of the first and second coils 22A and 22B is a flat coil whose turns are mainly wound parallel to an axial direction of the roller body 21 along the longer direction thereof. The coils 22A and 22B are formed along an inside wall of the roller body 21. Since the coils 22A and 22B are formed along the inside wall of the roller 2, there are a "narrow" gap (indicated by $\alpha$) and a "wide" gap (indicated by $\beta$) between turns of the coil wires that function as the coils 22A and 22B. The area $\beta$ having "wide" gaps between wire turns is settled at a position displaced by approximately one eighth of the outside peripheral length of the roller 2 from the center of the nip.

The coils 22A and 22B are divided into three portions, i.e., a center coil 22*a*, and end coils 22*b* and 22*c* at both sides of the center coil 22*a*, along the longer direction of the roller 2. Accordingly, each of these coils is represented by combinations of portions (A and B) along the periphery of the roller 2 and positions (a, b, and c) along the longer direction.

As will be discussed in more detail below with reference to FIG. 4, the same 2-system driving circuit drives the coils 22A (22Aa and 22Ab+22Ac) and 22B (22Ba and 22Bb+22Bc), namely, a set of the center coils 22Aa and 22Ba (also referred to as 22-1 according to the need for identification) and a set of end coils 22Ab, 22Ac, 22Bb, and 22Bc (also referred to as 22-2 according to the need for identification).

The coils 22 (22A and 22B, i.e., 22Aa, 22Ab+22Ac, 22Ba, and 22Bb+22Bc) each includes a litz wire formed by bundling a plurality of steel wires (16 wires in this example) each of which has a diameter of 1 mm and is insulated from the others by a highly heat-resistant polyamide-imide resin or the like. Since each of the coils 22 made from the litz wire, a wire diameter can be smaller than the depth of penetration for the skin effect when an alternate (high frequency) current is applied. Accordingly, it is possible to decrease a loss when a high-frequency current is supplied.

The press roller 3 has a specified thickness of a highly heat-resistant elastic material 31 such as silicon rubber, fluoro rubber, and the like formed on the surface of a shaft 3A.

Figure 3:
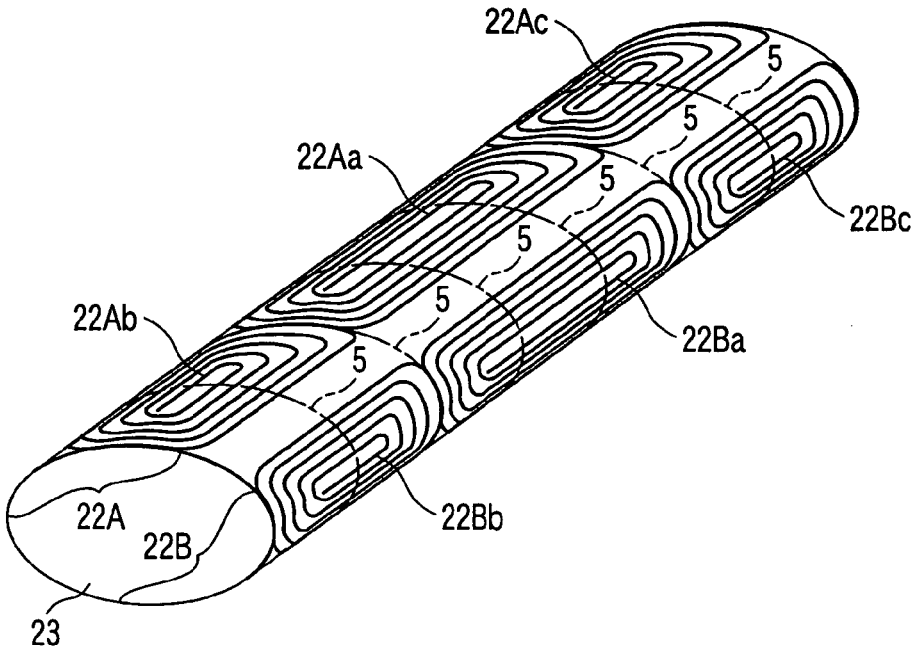
FIG. 3 is a schematic diagram showing the fixing apparatus in FIG. 2 viewed from a longer (axial) direction.

As shown in FIG. 3, there are six release claws 5 arranged along the longer direction of the heating roller 2. Two of the claws 5 are arranged at division positions along the longer direction of the coil 22, i.e., on the surface of the roller 2 corresponding to an area between the coils 22Aa(Ba) and 22Ab(Bb) and on the surface of the roller 2 corresponding to an area between the coils 22Aa(Ba) and 22Ac(Bc).

Figure 4:
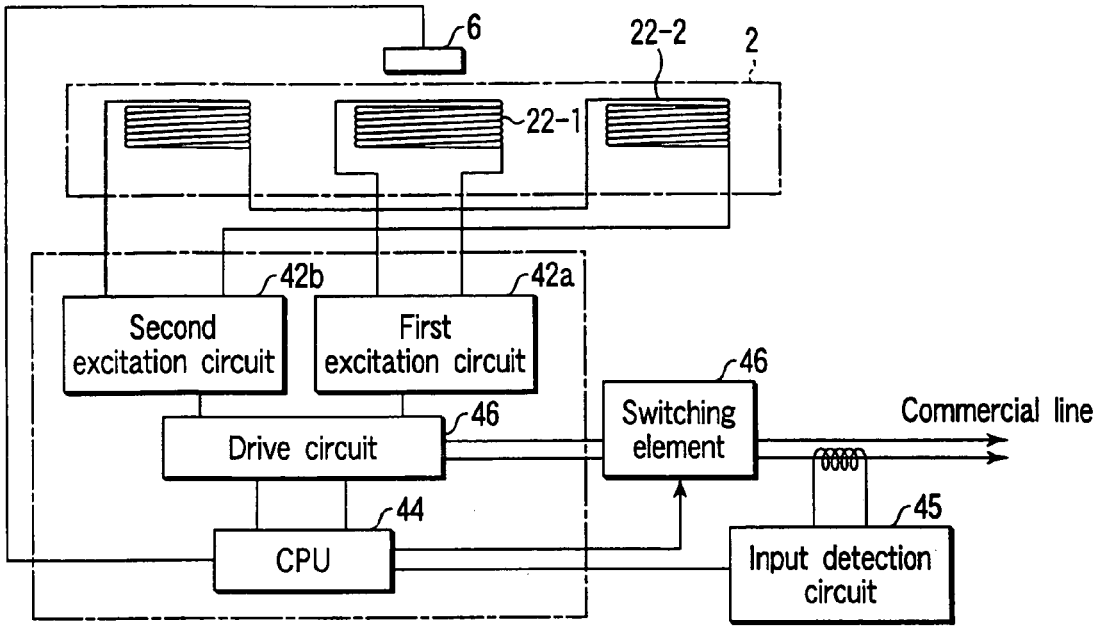
FIG. 4 is a schematic diagram illustrating an example of a driving circuit to drive an induction heating mechanism of the fixing apparatus shown in FIGS. 2 and 3.

FIG. 4 is a schematic block diagram showing a coil driving circuit that supplies a coil built in the heating roller with a coil current for generating induction power to cause an eddy current for heating the roller.

The center coils 22-1(22A and 22B) are connected to a first excitation circuit (inverter circuit) 42*a* of an excitation unit 41. The end coils 22-2 (22Ab, 22Bb, and 22Ac+22Bc) are connected to a second excitation circuit (inverter circuit) 42*b*. That is to say, the second excitation circuit 42*b* simultaneously supplies power to the coils 22Ab, 22Bb, and 22Ac+22Bc placed at both sides of the center coil 22-1.

The commercial power source (AC power supply) is supplied from the outside in response to a controlled output from the driving circuit 43. The frequency of the supplied AC power is converted into a specified frequency (high frequency) to generate a drive current. The excitation circuits 42*a* and 42*b* supplies the drive current to the respectively connected coils 22-1 and 22-2. Accordingly, a specified power is supplied to the center coil 22-1 and the both end coils 22-2 connected to the respective excitation circuit 42*a* and 42*b*.

The first and second excitation circuits 42*a* and 42*b* should output a high-frequency output, i.e., an inverter output. The inverter output is defined as an output from the driving circuit 43 corresponding to an instruction of a temperature control CPU 44 based on a temperature detected by the thermistor 7 on the outside periphery surface of the roller 2. A drive current (high-frequency current) magnitude is controlled in accordance with a change in the time when a switching element 46 is turned on under PWM (pulse width modulation) control corresponding to an input current magnitude (detection result) detected by an input detection circuit 45.

For the heating roller 2, for example, the coils 22-1 and 22-2 are supplied with high-frequency outputs having a specified frequency from the first and second excitation circuits 42*a* and 42*b* shown in FIG. 4, respectively. In this manner, the coils 22-1 (22Aa, 22Ba) and 22-2 (22Ab+22Ac, 22Bb+22Bc) generate a magnetic flux in a specified direction. In order to prevent a magnetic field change caused by the magnetic flux, a metal part of the roller 2 generates a magnetic flux and an eddy current. Consequently, the metal part of the roller 2 generates the Joule heat caused by the eddy current and a resistance of the metal part itself. As a result, the surface of the roller 2 is heated, i.e., the roller heats up.

When the center excitation coil 22-1 is applied with a high-frequency output to provide a frequency of 20 kHz and power of 1 kW, for example, the center of the roller 2 and its vicinity are heated to a specified temperature. When the both end coils 22-2 are applied with a high-frequency output to provide a frequency of 20 kHz and power of 1 kW, both ends of the roller 2 are heated to a specified temperature. Obviously, the thermistor 7 periodically monitors the surface temperature of the roller 2. The high-frequency output applied to the coils is turned on or off at a specified timing.

High-frequency outputs with different frequencies may be alternately applied to each of the coils, in this example, at least either the coil 22-1 (22Aa and 22Ba) or 22-2 (22Ab+22Ac and 22Ba+22Bc). In many cases under this condition, an interference sound may be generated if there is a large difference between the frequencies of high-frequency outputs. When high-frequency outputs are applied to the coils, alternately changing these coils greatly fluctuates a voltage in the same commercial circuit each time the coils are changed. For example, this may flicker the light from a discharge lamp such as a fluorescent lamp. Accordingly, it is preferable to apply the same high-frequency output to the center coil 22-1 and the both end coils 22-2.

In order to fix toner (toner image) on the paper P, the heating roller 2 must generate a uniform temperature along the circumferential direction. When the roller 2 stops rotating, however, magnetic fluxes occur with different intensities along the circumferential direction for the reason specific to the embodiment of using the air-core coil. Consequently, the heating roller 2 is subject to uneven temperature distribution along the circumferential direction. That is to say, temperature unevenness occurs along the circumferential direction of the roller 2.

At the time point when the paper P passes through the nip where the heating roller 2 touches the press roller 3, it is necessary to limit the temperature unevenness along the circumferential direction of the roller 2 within a specified allowable range. In consideration for this, each roller remains inactive for a specified time when the copying machine is turned on (to start turning on electricity for the coils). After the specified time elapses, the rollers start rotating to uniform the temperatures on the outside peripheries of the heating roller 2 and the press roller 3. In this manner, a constant heat quantity is applied to the entire outside periphery of each roller.

The toner image formed by an image forming section is transferred at a specified timing when the heating roller's surface temperature reaches a specified temperature, e.g., 180° C. or 200° C. By electrostatically retaining the toner, the paper P is carried to the nip between the heating roller 2 and the press roller 3. When the paper P passes through the nip, the toner on the paper P is fusion bonded and fixed on the paper P.

The color copying machine as shown in FIG. 1 thickens a toner layer because four types of toners Y, M, C, and Bk are layered.

For this reason, the fixing apparatus 1 needs to increase a nip width where the heating roller 2 touches the press roller 3. As mentioned above, the hardness of the press roller 3 is lowered to increase the nip width.

As mentioned above, decreasing the hardness of the press roller 3 becomes a major factor of curling a fixing medium toward the heating roller. The above-mentioned six release claws 5 need to be used to reliably separate the fixing medium from the heating roller.

Figure 5:
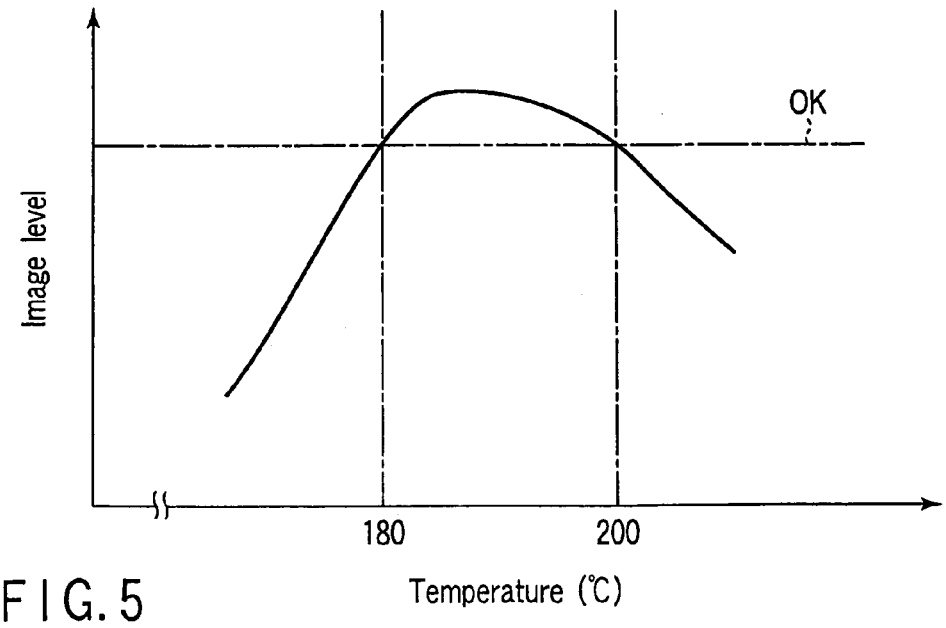
FIG. 5 is a graph showing temperatures of a heating roller for the fixing apparatus shown in FIGS. 2 and 3 and scratches due to the release claw on an image.

However, it is known that the use of the release claw 5 scratches a toner image, i.e., an image on the paper (fixing medium). As a result of subjective evaluation (visual check), FIG. 5 shows upper and lower bounds between the temperature at a releasing position (a position where the release claw 5 touches the roller 2) and a released mark on the image (a scratch caused by the release claw 5 on the toner image). For example, a mark of the release claw 5 becomes noticeable at 200° C. or higher or at 180° C. or lower.

A low release temperature makes the mark of the release claw 5 less noticeable. This can be explained as follows. A low temperature causes a weak adherence between the surface of the roller 2 and the toner. As a result, the paper can be separated with a small force.

On the other hand, the toner easily adheres to the surface of the roller at a high temperature. The release claw is used to peel the toner image from the surface of the roller 2, easily leaving the mark of the release claw on the image. It is proper to suppose that a high roller temperature also increases the temperature of the toner itself, easily leaving the claw mark on the toner image (i.e., easily deforming the toner image).

As mentioned above with reference to FIG. 2, the area β provides "coarse" gaps between wire turns of the first and second coils 22A and 22B for the heating roller 2. The area β is positioned downstream along the rotation direction of the press roller 3 and the heating roller 2 for the distance γ from the center of the nip where both rollers contact with each other.

Figure 6:
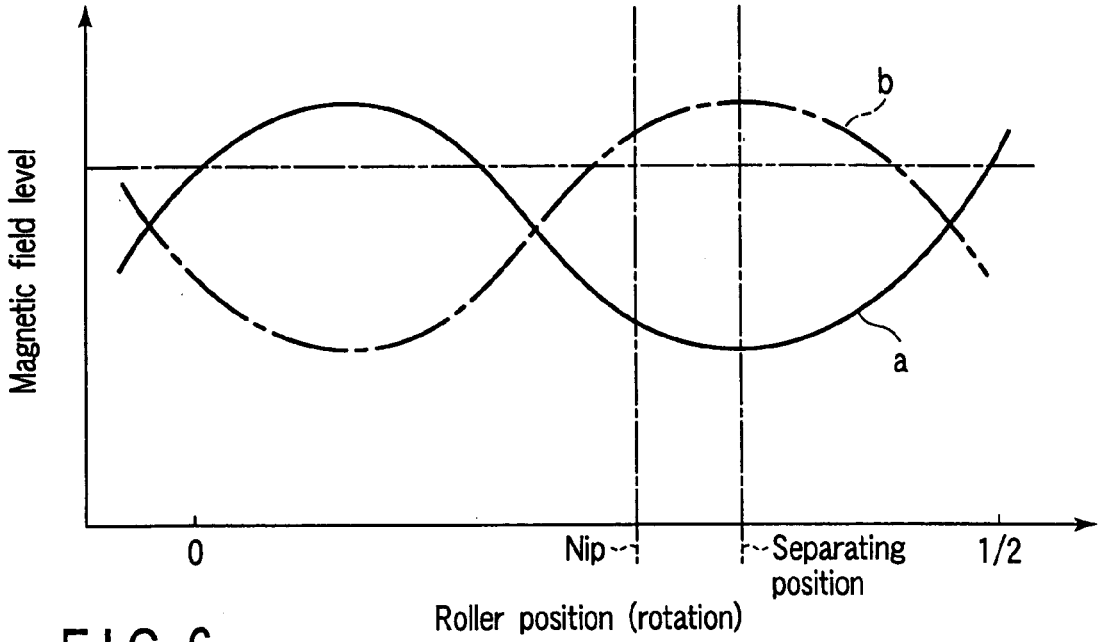
FIG. 6 is a graph showing an example of the magnetic field distribution generated by the induction heating mechanism of the fixing apparatus shown in FIGS. 2 and 3.

When the coils are observed by expansion as shown in FIG. 6, there is a correspondence between magnetic field intensities output from the coils 22A and 22B and "wide" and "narrow" gaps between the wire turns. That is to say, a maximum magnetic field is generated from the area α having narrow gaps between coil wire turns. A minimum magnetic field is generated from the area β having wide gaps between coil wire turns. When the roller 2 does not rotate, the roller body 21 is subject to temperature unevenness indicated by a curve a in FIG. 7 according to the magnetic field distribution indicated by a curve a in FIG. 6. as mentioned above with reference to FIG. 2, the release claw 5 is arranged at or near a position corresponding to the minimum magnetic field in FIG. 6, namely, a position corresponding to the minimum surface temperature of the roller 2 in FIG. 7.

Figure 7:
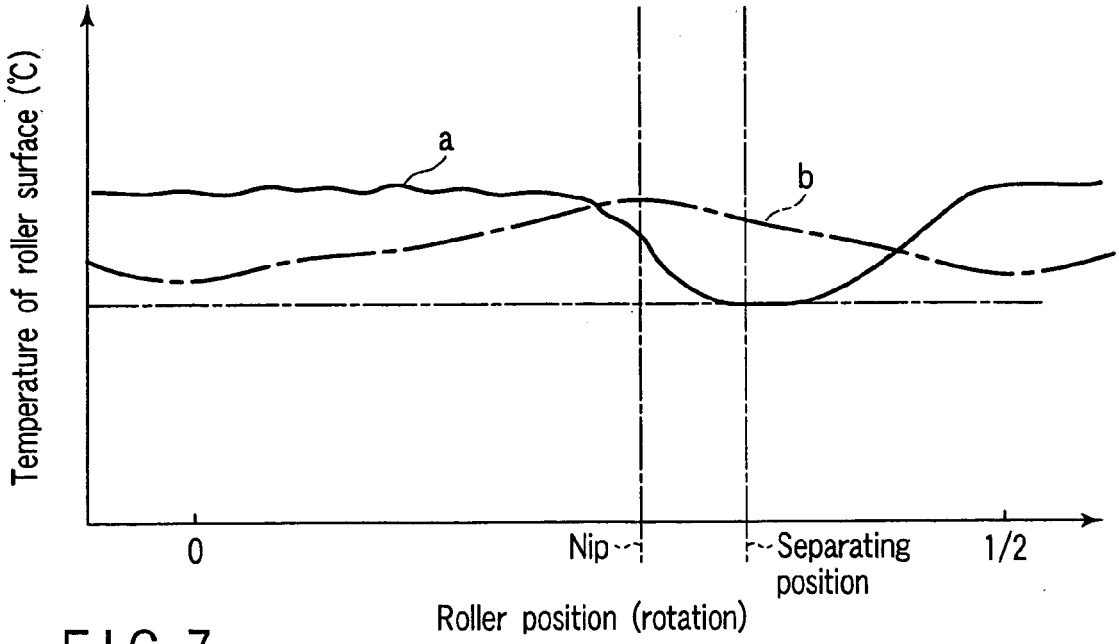
FIG. 7 is a graph showing an example of the relationship between a rotation of the heating roller for the fixing apparatus shown in FIGS. 2 and 3 and the temperature distribution of the heating roller.

When the release claw 5 is arranged at the position as explained in FIGS. 6 and 7, the release claw 5 touches the roller 2 as described with reference to FIG. 5. In this manner, the image is hardly subject to a release mark (a scratch caused by the release claw 5 on the toner image).

That is to say, the flat coils 22A and 22B are arranged along the inside periphery of the roller 2 to cause the magnetic field distribution along the peripheral direction of the roller 2. The heat distribution occurs on the roller 2 based on the magnetic field distribution and is subject to the positional dependence. Fixing a toner image decreases the temperature. By using these characteristics, the paper is separated at a position where the surface of the heating roller 2 shows the lowest temperature downstream from the nip position along the rotation direction of the roller 2. In this manner, it is possible to suppress occurrence of a scratch on the image due to the release claw. There is no problem about the fixing property because the nip position differs from the separating position and can sufficiently ensure the magnetic field magnitude and the heat generation corresponding thereto.

Figure 10:
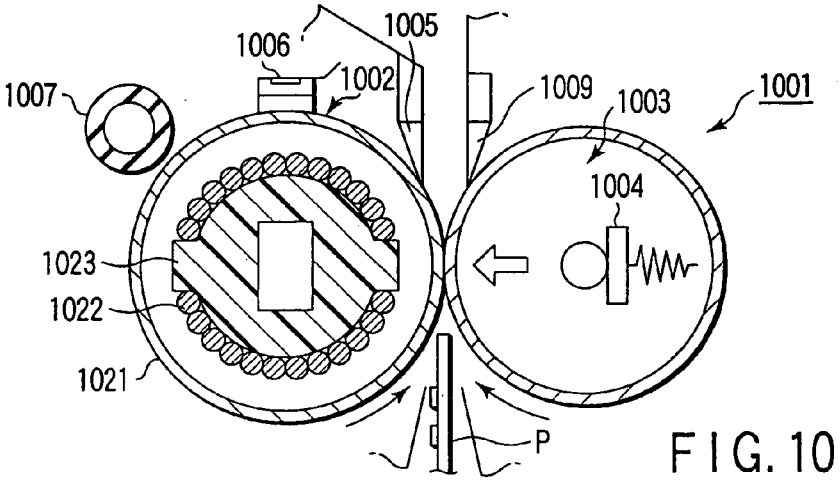
FIG. 10 is a schematic diagram showing an example of modifying parts of the fixing apparatus shown in FIG. 2 for comparison with the fixing apparatus in FIG. 2.

For comparison, FIG. 10 shows a fixing apparatus 1001. There is a gap between two flat coils 1022 that are arranged along the inside of a heating roller 1002. The gap is positioned to a nip where the heating roller 1002 touches a press roller 1003. The magnetic field distribution occurs along the peripheral direction of the roller 1002. The heat distribution of the roller 1002 occurs based on the magnetic field distribution. FIGS. 6 and 7 show the magnetic field distribution and the heat distribution respectively using a curve b (dot-dash line).

FIG. 6 has made it clear that the known fixing apparatus settles the separating position near the peak of the magnetic field distribution.

Accordingly, it is proven that separating the paper in contact with the roller 1002 easily causes a scratch of the release claw on the toner image for the above-mentioned reason. Further, FIG. 7 also proves that the paper is separated near the position that corresponds to the heat generation peak and easily allows the release claw to scratch an image despite much heat consumption at the nip for fixing the toner image in accordance with the magnetic field distribution described with reference to FIG. 6.

With respect to a scratch on images by using the release claw, the same consideration can be given to the longer direction of the heating roller 2 according to the magnetic field distribution described with reference to FIGS. 6 and 7 and the heat generation distribution corresponding to the magnetic field distribution.

As shown in FIGS. 2 and 3, when the coils 22A an 22B are divided into two or more elements along the longer direction of the heating roller 2, it is preferable to provide the release claw 5 at a position where the gaps of the coils along the longer direction.

As mentioned above with reference to FIGS. 2 and 3, for example, let us suppose that the coils 22A and 22B are arranged along the inside periphery of the roller 2 and comprise three elements indicated by a, b, and c. At least two release claws 5 are positioned between the respective elements a and b, i.e., between the coils 22Aa and 22Ab and between the coils 22Ba and 22Bb. At least another two release claws 5 are positioned between the respective elements a and c, i.e., between the coils 22Aa and 22Ac and between the coils 22Ba and 22Bc. The arrangement can decrease changes of scratching a fixed toner image by the release claws.

As will be apparent from FIG. 3, however, the release claw is not always positioned to a boundary between the coils. According to the example in FIG. 3, only two out of six release claws can be positioned to boundaries between the coils. In this case, it is also possible to decrease chances of scratching toner images by positioning the remaining release claws to the area β where there are "wide" gaps between coil wire turns as mentioned above with reference to FIG. 2.

As mentioned above, it is possible to prevent the toner from unnecessarily adhering to the release claw by positioning the release claws 5 to the area allowing "wide" gaps between wire turns of the coils arranged along the roller's inside periphery and/or to a boundary between the coils that are provided separately along the longer direction of the roller. Even if images are formed for an increased number of times, it is possible to prevent a scratch by the release claw on a fixed toner image.

The following describes effects of the release claws that are provide at the positions under the conditions as mentioned above.

We used the fixing apparatus as described with reference to FIGS. 2 and 3 to fix an A4-size solid image with a toner coating mass of approximately 1.2 mg/cm$^2$ on paper having a specified thickness. The toner coating mass is changed as needed.

We visually checked to evaluate a fixed image formed under these conditions and determined the presence or absence of a scratch due to the release claw and a degree or level of the scratch if found using the following symbols:

X when a release mark (scratch) due to the release claw is visually checked; and ○ when no scratch is visually checked.

By changing the conditions, we evaluated results of fixing and separating the specified number of toner images based on the above-mentioned criteria. We assumed a releasable condition if all the conditions result in the level (○) for no scratch checked visually.

[Experimental Result 1]

A fixing process speed is set to 130 mm/s. As shown in FIG. 3, a total of six release claws 5 are arranged along the longer direction of the heating roller 2. An A4-size solid image is fixed by specifying the toner coating mass of approximately 1.2 mg/cm$^2$. . . . "○"

[Comparative Example 1]

The fixing apparatus as described in FIGS. 2 and 3 is used. The release claws are arranged at the positions as shown in FIG. 9. A toner image is fixed under the conditions specified in Experimental Result 1. . . . "x"

[Experimental Result 2]

The fixing apparatus as described in FIGS. 2 and 3 is used. A fixing process speed is set to 210 mm/s. An A4-size solid image is fixed by specifying the toner coating mass of approximately 1.2 mg/cm$^2$. Experimental Result 2 changes the position γ of the release claw as described in FIG. 2. Experimental Result 2 uses the same area β for "wide" gaps between coil wire turns as that for Experimental Result 1.

First, the position γ for the release claw is set to the approximate center of the area β for "wide" gaps between coil wire turns. An A4-size solid image is fixed by specifying the toner coating mass of approximately 1.2 mg/cm$^2$. . . . "○"

Next, by leaving the release claw position unchanged, an A4-size solid image is fixed by specifying the toner coating mass of approximately 1.4 mg/cm$^2$. . . . "X"

Then, the position γ for the release claw is moved from the approximate center of the area β for "wide" gaps between coil wire turns by a specified amount (1/16 of the circumference of the roller 2) downstream along the rotation direction of the roller 2. An A4-size solid image is fixed by specifying the toner coating mass of approximately 1.4 mg/cm$^2$. The nip width is increased at a specified rate because of an increased process speed. . . . "○"

Then, the position γ for the release claw is moved from the approximate center of the area β for "wide" gaps between coil wire turns by a specified amount (1/8 of the circumference of the roller 2) downstream along the rotation direction of the roller 2. An A4-size solid image is fixed by specifying the toner coating mass of approximately 1.4 mg/cm$^2$. The nip width is increased at a specified rate because of an increased process speed. . . . "○"

Further, the position γ for the release claw is moved from the approximate center of the area β for "wide" gaps between coil wire turns by a specified amount (1/6 of the circumference of the roller 2) downstream along the rotation direction of the roller 2. An A4-size solid image is fixed by specifying the toner coating mass of approximately 1.4 mg/cm$^2$. . . . "X"

Then, a fixing process speed is set to 400 mm/s. The position γ for the release claw is moved from the approximate center of the area β for "wide" gaps between coil wire turns by a specified amount (1/8 of the circumference of the roller 2) downstream along the rotation direction of the roller 2. An A4-size solid image is fixed by specifying the toner coating mass of approximately 1.4 mg/cm$^2$. The nip width is increased at a specified rate because of an increased process speed. . . . "○"

Moreover, a fixing process speed is set to 400 mm/s as the same condition. The position γ for the release claw is moved from the approximate center of the area β for "wide" gaps between coil wire turns by a specified amount (1/6 of the circumference of the roller 2) downstream along the rotation direction of the roller 2. An A4-size solid image is fixed by specifying the toner coating mass of approximately 1.4 mg/cm$^2$. . . . "○"

Figure 8:
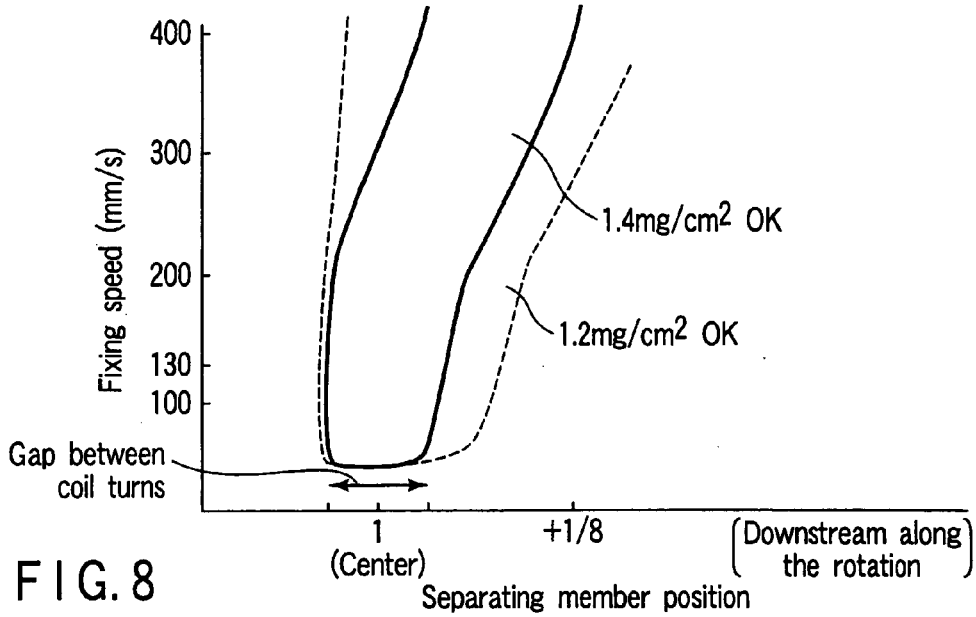
FIG. 8 is a graph showing an example of the relationship among the revolution speed (movement speed on the roller surface) of the heating roller for the fixing apparatus shown in FIGS. 2 and 3, the magnetic field distribution specific to the heating mechanism, and the amount of toner to be fixed.

From these results, we confirmed that, as shown in FIG. 8, both the process speed and the toner coating mass affect the distance γ between an appropriate position capable of arranging the release claw and the approximate center of the area β for "wide" gaps between coil wire turns. Further, we confirmed that the upper bound of the distance γ is 1/8 of the circumference of the roller 2 when the process speed is set to 400/ms and the toner coating mass is set to approximately 1.4 mg/cm$^2$ on an A4-size solid image. As shown in FIG. 8, both the process speed and the toner coating mass affect the distance γ appropriately capable of arranging the release claw. Moreover, we confirmed that the upper bound of the distance γ is 1/6 of the circumference of the roller 2 when the process speed is set to 400/ms and the toner coating mass is set to approximately 1.2 mg/cm$^2$ on an A4-size solid image.

When the process speed is set to 400 m/s or higher for a recent mainstream color image forming apparatus, it is preferable to set the upper bound of γ to 1/8 of the circumference of the roller 2.

[Experimental Result 3]

The following describes results of confirming a boundary between the coils divided along the longer direction of the heating roller explained with reference to FIG. 3 and the position of the release claw.

A fixing process speed is set to 130 mm/s. As shown in FIG. 3, a total of six release claws 5 are arranged along the longer direction of the heating roller 2. An A4-size solid image is fixed by specifying the toner coating mass of approximately 1.2 mg/cm$^2$. . . . "○"

Subsequently, we checked for release claw marks after fixing the image on 50000 sheets and then another 50000 sheets (a total of 100000 sheets) at the 6% printout ratio. . . . "○"

Under the same condition except the toner coating mass of approximately 1.4 mg/cm$^2$, we checked for release claw marks after fixing the image on 50000 sheets and then another 50000 sheets (a total of 100000 sheets) at the 6% printout ratio. . . . "○"

[Comparative Example 2]

As shown in FIG. 3, the release claw is positioned to a boundary between the coils divided along the longer direction of the heating roller. We moved the release claw to a position other than the coil boundary and repeated the fixing operation under the same condition as for Experimental Result 3. We confirmed no scratch due to the release claw on an A4-size solid image fixed by specifying the toner coating mass of approximately 1.2 mg/cm$^2$. . . . "○"

Under the same condition except the toner coating mass of approximately 1.4 mg/cm$^2$, however, we repeated the fixing operation on 50000 sheets at the 6% printout ratio to find a scratch due to the release claw in the middle of the operation. . . . "X"

A scratch due to the release claw temporarily disappears from the fixed image by performing maintenance to remove the toner from the release claw. However, we confirmed a scratch due to the release claw in the middle of repeating the fixing operation on 50000 sheets. . . . "X"

[Experimental Result 4]

The fixing apparatus as described in FIGS. 2 and 3 is used. A fixing process speed is set to 210 mm/s. An A4-size solid image is fixed by specifying the toner coating mass of approximately 1.2 mg/cm$^2$. Under the condition used for Experimental Result 2, the position γ of the release claw is set to the approximate center of the area β for "wide" gaps between coil wire turns to fix the A4-size solid image by specifying the toner coating mass of approximately 1.2 mg/cm$^2$. . . . "○"

Subsequently, we checked for release claw marks after fixing the image on 50000 sheets and then another 50000 sheets (a total of 100000 sheets) at the 6% printout ratio. . . . "○"

Next, by leaving the release claw position unchanged, an A4-size solid image is fixed by specifying the toner coating mass of approximately 1.4 mg/cm$^2$. However, we confirmed a scratch due to the release claw in the middle of repeating the fixing operation on 50000 sheets at the 6% printout ratio. . . . "X"

Then, the position γ for the release claw is moved from the approximate center of the area β for "wide" gaps between coil wire turns by a specified amount (⅛ of the circumference of the roller 2) downstream along the rotation direction of the roller 2. An A4-size solid image is fixed by specifying the toner coating mass of approximately 1.4 mg/cm$^2$. The nip width is increased at a specified rate because of an increased process speed. . . . "○"

Next, the position γ for the release claw is moved from the approximate center of the area β for "wide" gaps between coil wire turns by a specified amount (⅛ of the circumference of the roller 2) downstream along the rotation direction of the roller 2. We repeated the fixing operation on 50000 sheets at the 6% printout ratio by specifying the toner coating mass of approximately 1.4 mg/cm$^2$. The nip width is increased at a specified rate because of an increased process speed. . . . "○"

Further, the position γ for the release claw is moved from the approximate center of the area β for "wide" gaps between coil wire turns by a specified amount (⅙ of the circumference of the roller 2) downstream along the rotation direction of the roller 2. An A4-size solid image is fixed by specifying the toner coating mass of approximately 1.4 mg/cm$^2$. . . . "X"

Then, a fixing process speed is set to 400 mm/s. The position γ for the release claw is moved from the approximate center of the area β for "wide" gaps between coil wire turns by a specified amount (⅛ of the circumference of the roller 2) downstream along the rotation direction of the roller 2. The toner coating mass is set to approximately 1.4 mg/cm$^2$. We repeated the fixing operation on 50000 sheets at the 6% printout ratio. The nip width is increased at a specified rate because of an increased process speed. After the image is fixed on 100000 sheets thereafter, the image shows no scratch due to the release claw. . . . "○"

A fixing process speed is set to 400 mm/s as the same condition. The position γ for the release claw is moved from the approximate center of the area β for "wide" gaps between coil wire turns by a specified amount (⅙ of the circumference of the roller 2) downstream along the rotation direction of the roller 2. An A4-size solid image is fixed by specifying the toner coating mass of approximately 1.4 mg/cm$^2$. . . . "X"

From these results, we confirmed that, as shown in FIG. 8, both the process speed and the toner coating mass affect the distance γ between an appropriate position capable of arranging the release claw and the approximate center of the area β for "wide" gaps between coil wire turns. Further, we confirmed that the upper bound of the distance γ is ⅛ of the circumference of the roller 2 when the process speed is set to 400/ms and the toner coating mass is set to approximately 1.4 mg/cm$^2$ on an A4-size solid image. As shown in FIG. 8, both the process speed and the toner coating mass affect the distance γ appropriately capable of arranging the release claw. Moreover, we confirmed that the upper bound of the distance γ is ⅙ of the circumference of the roller 2 when the process speed is set to 400/ms and the toner coating mass is set to approximately 1.2 mg/cm$^2$ on an A4-size solid image.

Further, we also confirmed that the toner easily adheres to the release claw if either the toner coating mass or the process speed exceeds the specified value.

As mentioned above, the induction heating fixing apparatus according to the present invention has the heating roller in which flat coils are provided along the inside wall of the roller. There is provided the area that corresponds to "wide" gaps between coil wire turns and generates a few magnetic fields. The area is positioned downstream along the rotation of the heating roller from the nip defined between the press roller and the heating roller. The release claw is provided at the center of the area or near the center thereof downstream along the rotation of the heating roller. This makes it possible to suppress a scratch due to the release claw on a fixed toner image.

As the toner coating mass increases, the release claw position is configured to be shifted toward downstream along the rotation of the heating roller from the area that corresponds to "wide" gaps between coil wire turns. This makes it possible to suppress a scratch due to the release claw on a fixed toner image.

When the coils are divided into a plurality of elements, the release claw is provided at a boundary between the coils. This makes it possible to suppress a scratch due to the release claw on a fixed toner image.

While the above-mentioned embodiment of the present invention have described the color copying machine as an example, it is obvious that the present invention is applicable to monochrome copying machines and printers.

While there has been described the fixing apparatus using the heating roller and the press roller as an example, it is obvious that a heat-resistant belt-shaped heat conductor may be arranged around the heating roller.

If the nip maintains a temperature capable of fixing an image, the toner does not peel off at a separating position using the release claw, providing stable fixing. The above-mentioned embodiment is especially effective for thin, cylindrical metal rollers and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An induction heating fixing apparatus comprising:

a cylindrical member;

an induction current generation mechanism including first and second coils for allowing the cylindrical member to be heated to generate an eddy current, wherein the first and second coils are separated into two or more elements at a cross section orthogonal to a direction along which the cylindrical member to be heated rotates, the coils having a wide gap between wire turns;

a pressing member which contacts with the cylindrical member to be heated and can provide a nip having a specified width in cooperation with the cylindrical member to be heated; and a releasing mechanism which, from the cylindrical member to be heated, separates a fixing member passing through the nip between the cylindrical member to be heated and the pressing member, wherein the releasing mechanism is provided at a specified position on an outside periphery of the cylindrical member to be heated in correspondence with a position causing a wide gap between wire turns of the first and second coils in the induction current generation mechanism, wherein the releasing mechanism contacts with the cylindrical member to be heated, wherein there is the position causing the gap between wire turns of the first and second coils in the induction current generation mechanism, and that position is shifted for a specified amount downstream from the nip in a direction along which the cylindrical member to be heated moves, and wherein an upper bound of the shift amount is ⅛ of a circumference of the cylindrical member to be heated.

2. The fixing apparatus according to claim 1, wherein an upper bound of the shift amount is ⅙ of a circumference of the cylindrical member to be heated.

3. The fixing apparatus according to claim 1, wherein a movement speed at any position on the cylindrical member to be heated is 200 mm/s.

4. The fixing apparatus according to claim 3, wherein a movement speed at any position on the cylindrical member to be heated is 400 mm/s.

5. A fixing apparatus using induction heating comprising:

a cylindrical member;

an induction current generation mechanism including first and second coils for allowing the cylindrical member to be heated to generate an eddy current, wherein the first and second coils are separated into two or more elements at a cross section orthogonal to a direction along which the cylindrical member to be heated moves and along a longer direction of the cylindrical member to be heated;

a pressing member which contacts with the cylindrical member to be heated and can provide a nip having a specified width in cooperation with the cylindrical member to be heated; and releasing mechanisms which, from the cylindrical member to be heated, separate a fixing member passing through the nip between the cylindrical member to be heated and the pressing member, wherein at least one of the releasing mechanisms is provided at a specified position on an outside periphery of the cylindrical member to be heated in correspondence with a position causing a wide gap between wire turns of the first and second coils in the induction current generation mechanism, and at a specified position on an outside periphery of the cylindrical member to be heated in correspondence with a position for separating the first and second coils in the induction current generation mechanism along a longitudinal direction of the cylindrical member to be heated, wherein the releasing mechanisms contact with the cylindrical member to be heated, wherein there is the position causing the wide gap between wire turns of the first and second coils in the induction current generation mechanism, and that position is shifted for a specified amount downstream from the nip in a direction along which the cylindrical member to be heated moves, and wherein a movement speed at any position on the cylindrical member to be heated is 200 mm/s and an upper bound of the shift amount is ⅛ of a circumference of the cylindrical member to be heated.

6. The fixing apparatus according to claim 5, wherein a movement speed at any position on the cylindrical member to be heated is 400 mm/s and an upper bound of the shift amount is ⅙ of a circumference of the member to be heated.

* * * * *